US008469449B2

(12) United States Patent
Kao

(10) Patent No.: US 8,469,449 B2
(45) Date of Patent: Jun. 25, 2013

(54) AUTOMATICALLY ADJUSTABLE CHAIR STRUCTURE

(76) Inventor: Ghi-Hwei Kao, Taipei (TW)

( * ) Notice: Subject to any disclaimer, the term of this patent is extended or adjusted under 35 U.S.C. 154(b) by 430 days.

(21) Appl. No.: 12/945,894

(22) Filed: Nov. 15, 2010

(65) Prior Publication Data

US 2012/0119552 A1 May 17, 2012

(51) Int. Cl.
*A47C 1/024* (2006.01)

(52) U.S. Cl.
USPC ..... 297/325; 297/302.2; 297/327; 297/259.2; 297/260.1; 297/258.1

(58) Field of Classification Search
USPC ..... 297/325–328, 302.1, 302.2, 258.1, 297/260.1, 259.2, 259.4, 270.1, 271.5, 271.6, 297/271.2
See application file for complete search history.

(56) References Cited

U.S. PATENT DOCUMENTS

| | | | | |
|---|---|---|---|---|
| 490,366 | A * | 1/1893 | Seng | 297/310 |
| 2,699,200 | A * | 1/1955 | Lingle | 297/325 |
| 4,123,102 | A * | 10/1978 | Landry et al. | 297/270.2 |
| 6,595,584 | B1 * | 7/2003 | Caldwell | 297/258.1 |
| 8,100,475 | B2 * | 1/2012 | Habing | 297/260.1 |

* cited by examiner

*Primary Examiner* — Anthony D Barfield

(57) ABSTRACT

An automatically adjustable chair structure essentially includes a chair body, a base, an extension bar, at least one first cushion mechanism, and at least one second cushion mechanism. When a user sits on the chair body, the user's body weight is cushioned by the first and second cushion mechanisms. In addition, the two sled runner-shaped supports lying on the floor and the pivotable design of the extension bar allow the extension bar to move backward. Thus, the tilt angle of the chair body can be automatically changed to suit the user's sitting posture.

4 Claims, 5 Drawing Sheets

AUTOMATICALLY ADJUSTABLE CHAIR STRUCTURE

BACKGROUND OF THE INVENTION

1. Technical Field

The present invention relates to an automatically adjustable chair structure and, more particularly, to a chair structure whose tilt angle is automatically adjustable.

2. Description of Related Art

Most chairs only serve as articles to be sat on. To increase sitting comfort, the seat of a chair is typically padded with a soft material. Nevertheless, chair design is often more esthetic-oriented than function-oriented. While there are chairs whose heights can be adjusted according to the intended sitting heights via adjustment devices provided below the seats, and/or whose backrests can be finely adjusted so as to be leaned against by the users' backs, all these designs provide passive adjustment only; in other words, the desired chair heights and backrest tilt angles must be adjusted by the users themselves to adapt to the users' sitting heights and postures, which is very inconvenient. Moreover, the aforesaid chairs only allow the chair heights and/or backrest tilt angles to be adjusted, but do not allow the overall tilt angles of the chairs to be changed according to the users' sitting positions. Hence, a user who has sat on such a chair for a long time must feel uncomfortable and may be subject to spine injury.

BRIEF SUMMARY OF THE INVENTION

The primary object of the present invention is to provide an automatically adjustable chair structure which essentially includes a chair body, a base, an extension bar, at least one first cushion mechanism, and at least one second cushion mechanism. When a user sits on the chair body, the user's body weight is cushioned by the first and second cushion mechanisms. In addition, the two sled runner-shaped supports at a front bottom portion of the chair body and the pivotable design of the extension bar allow the extension bar to move backward, thereby changing the tilt angle of the chair body according to the user's sitting posture.

The secondary object of the present invention is to provide the foregoing chair structure, wherein the two sled runner-shaped supports extended from the front bottom portion of the chair body have a curved shape, and the extension bar has one end pivotally connected to a bottom portion of the base and the other end provided with a caster. When a user sits on the chair body, the two sled runner-shaped supports lying on the floor and the caster of the extension bar allow the extension bar to slide easily backward in response to a change of the user's sitting position. Thus, the tilt angle of the chair body is automatically adjustable according to the user's sitting posture.

BRIEF DESCRIPTION OF THE SEVERAL VIEWS OF THE DRAWINGS

The structure as well as a preferred mode of use, further objects, and advantages of the present invention will be best understood by referring to the following detailed description of a preferred embodiment in conjunction with the accompanying drawings, in which.

DETAILED DESCRIPTION OF THE INVENTION

Figure 1:
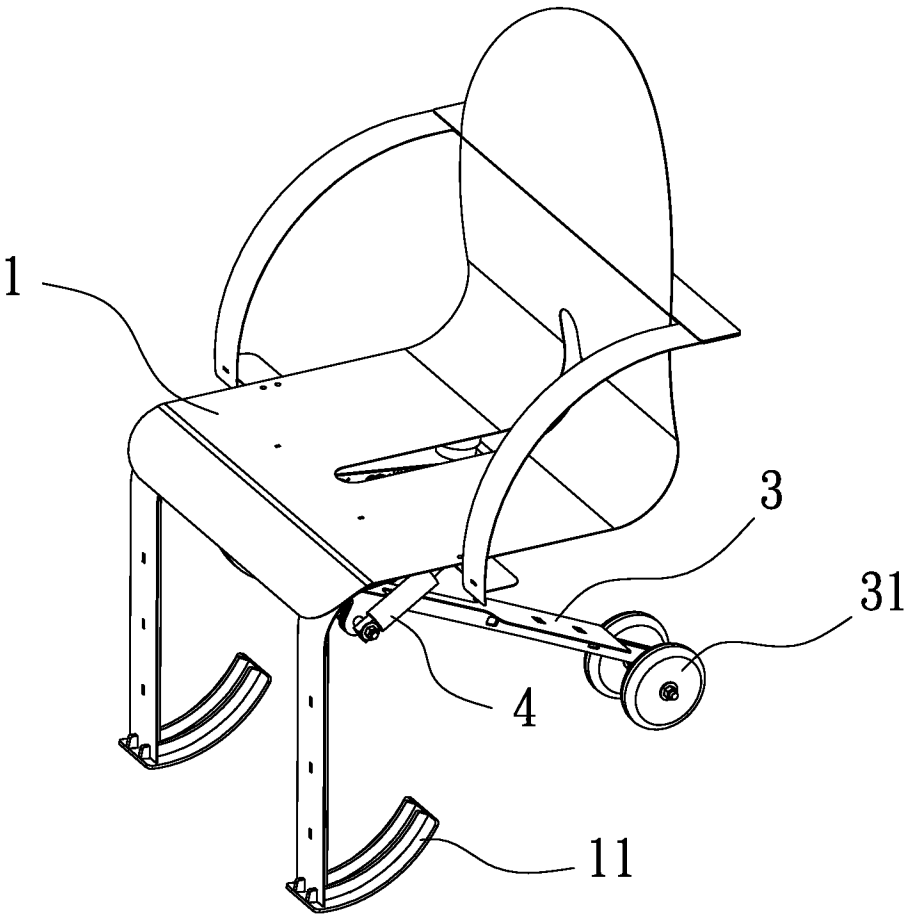
FIG. 1 is an assembled perspective view of the present invention.
Figure 2:
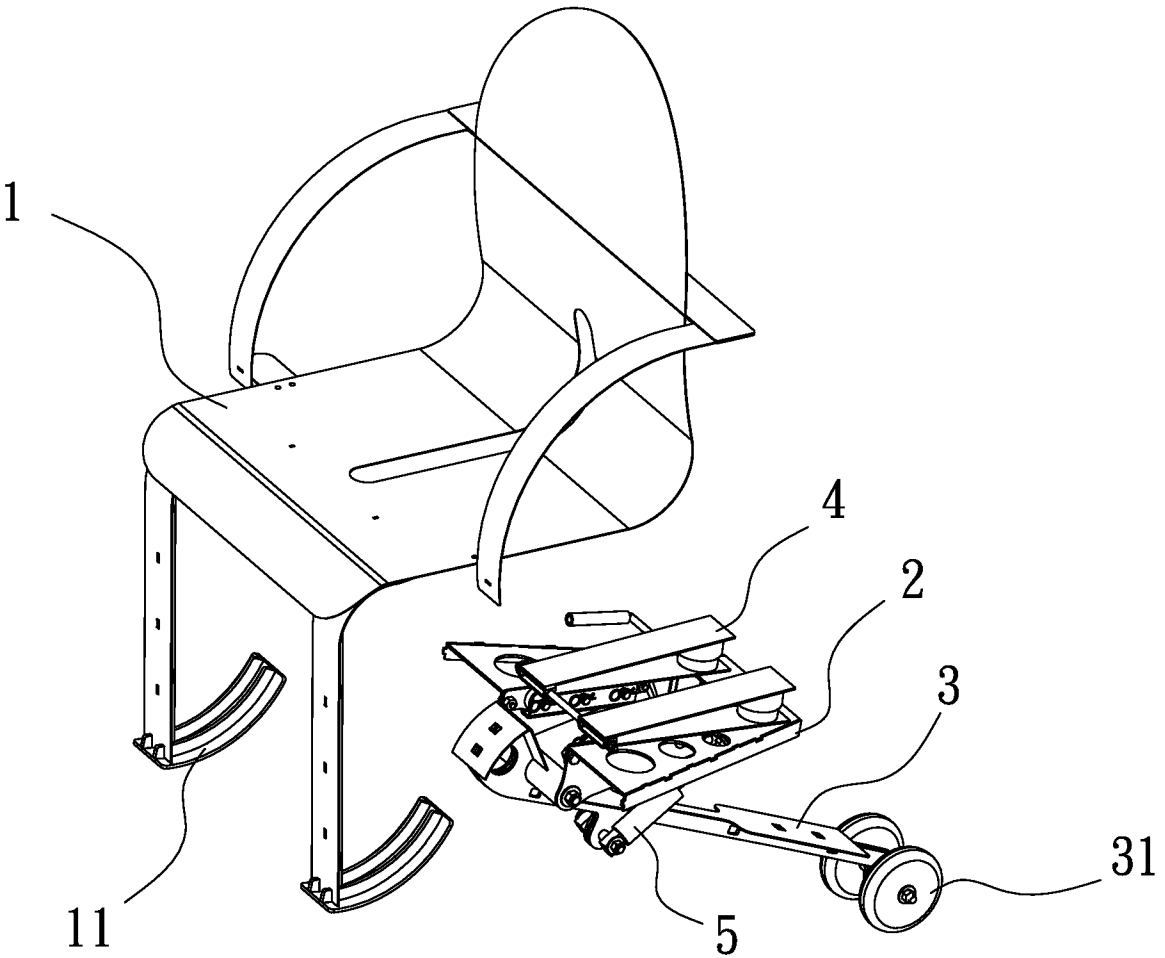
FIG. 2 is an exploded perspective view of the present invention.
Figure 3:
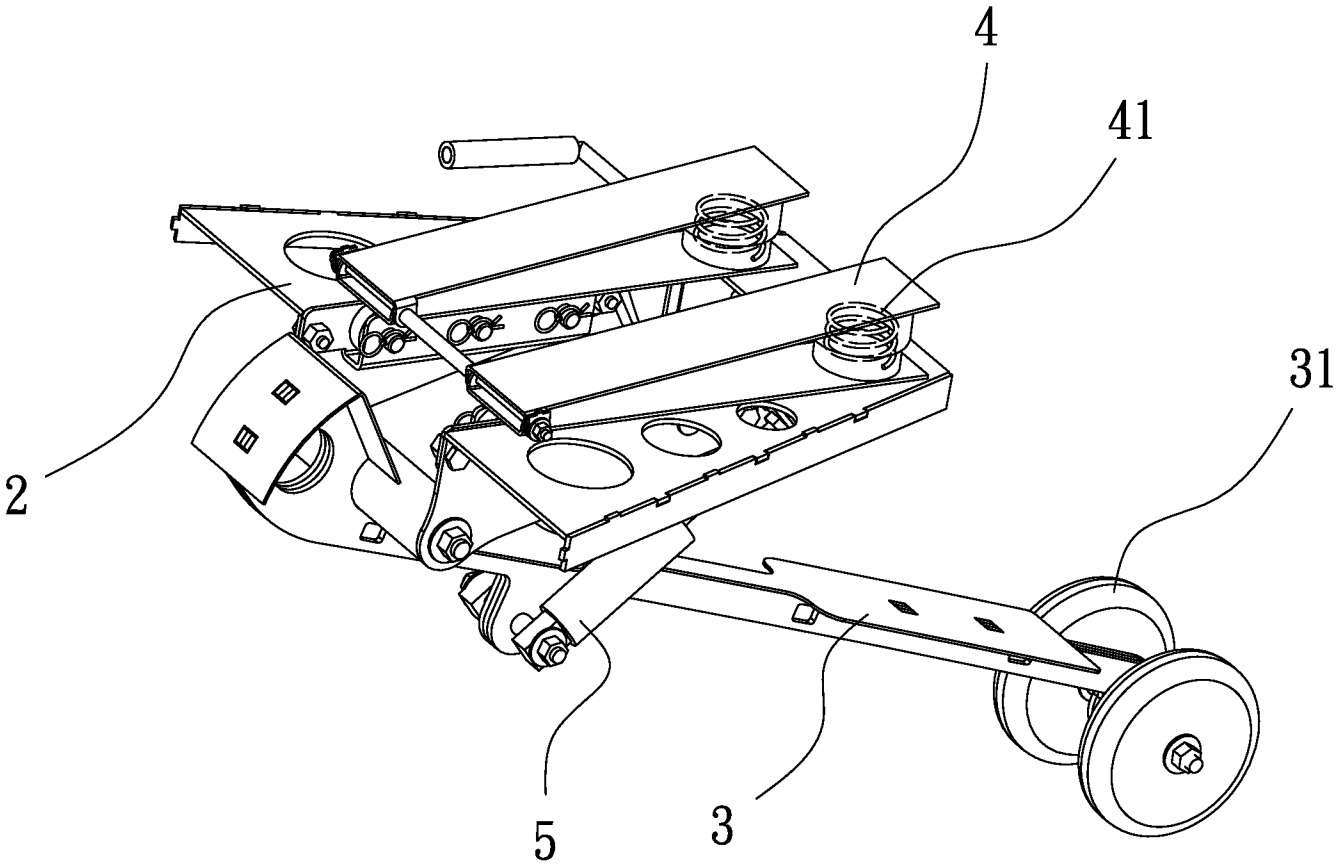
FIG. 3 is a partial perspective view of the present invention.
Figure 4:
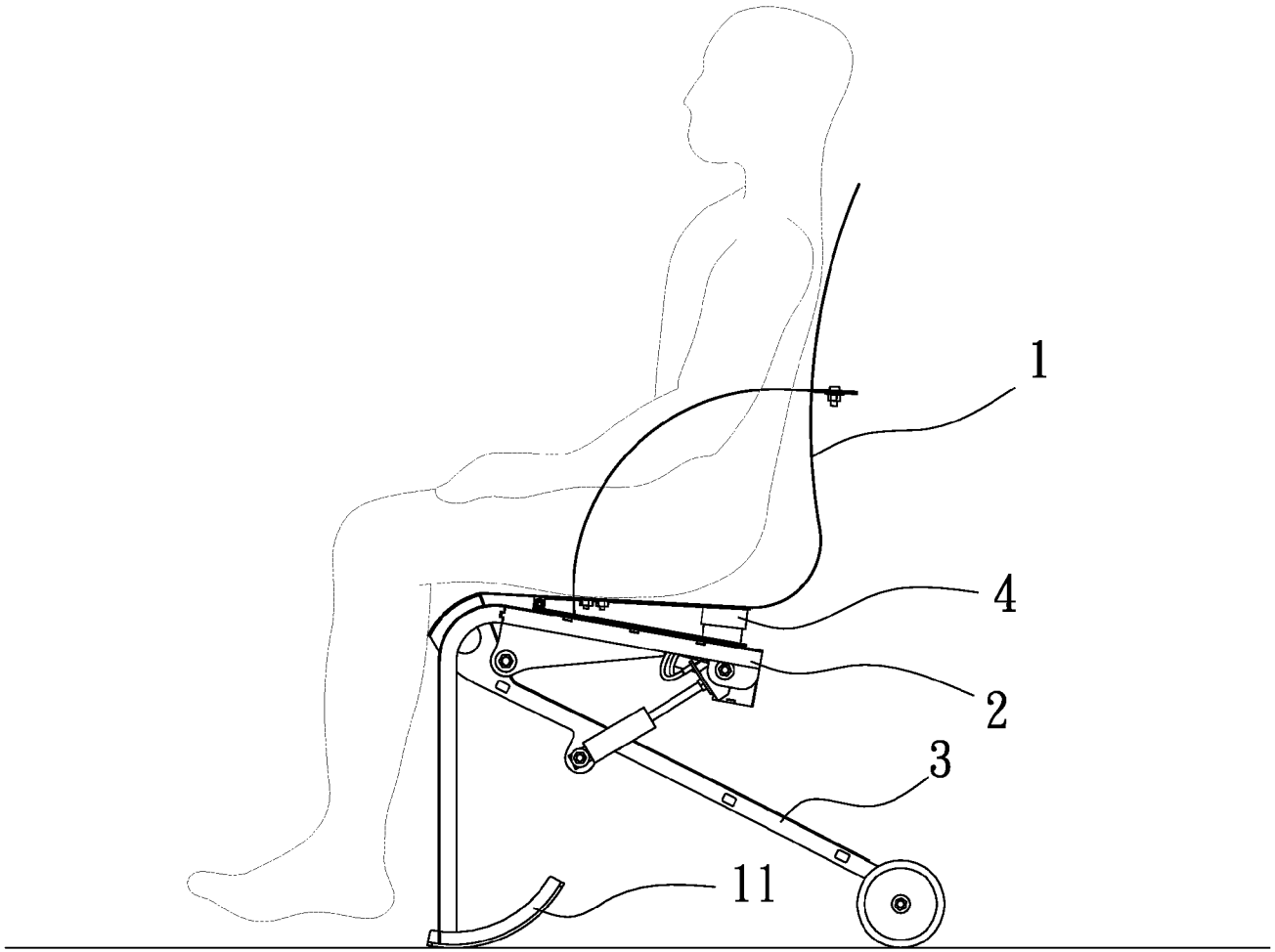
FIG. 4 is aside elevation showing the present invention in use.
Figure 5:
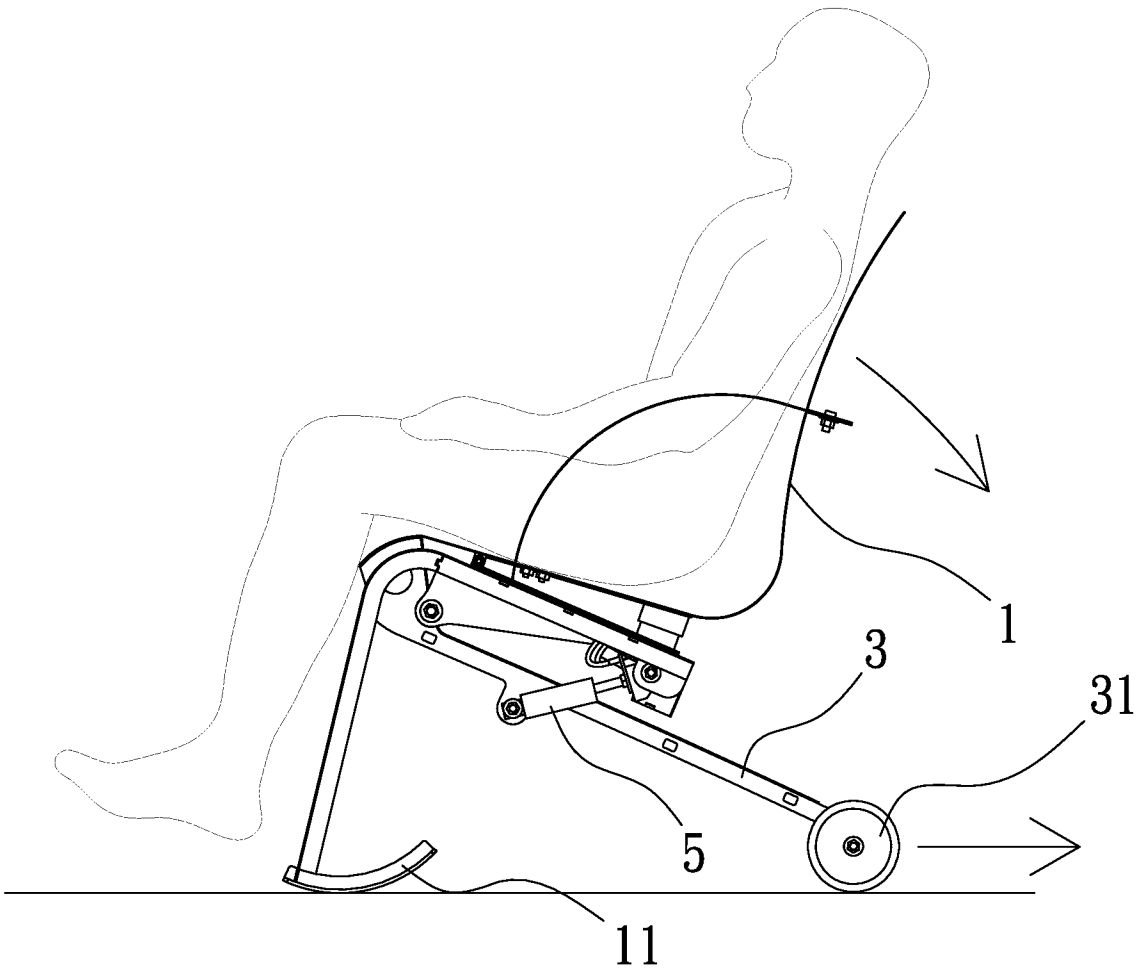
FIG. 5 is another side elevation showing the present invention in use.

Please refer to FIGS. 1 through 5 for an assembled perspective view, an exploded perspective view, a partial perspective view, and two side elevations of the present invention. As shown in the drawings, an automatically adjustable chair structure according to a preferred embodiment of the present invention essentially includes a chair body 1, a base 2, an extension bar 3, at least one first cushion mechanism 4, and at least one second cushion mechanism 5.

The chair body 1 is configured to be sat on and has a front bottom portion extended with two corresponding sled runner-shaped supports 11.

The base 2 is provided at a bottom portion of the chair body 1.

The extension bar 3 has one end pivotally connected to a bottom portion of the base 2 and the other end provided with a caster 31.

The first cushion mechanisms 4 are located between the chair body 1 and the base 2. Each first cushion mechanism 4 is provided therein with at least one resilient element 41.

The second cushion mechanisms 5 are pivotally connected between the bottom portion of the base 2 and the extension bar 3. Each second cushion mechanism 5 is a hydraulic cylinder or a pneumatic cylinder.

In use, the two sled runner-shaped supports 11 and the caster 31 at one end of the extension bar 3 are placed on the floor. Once the user sits on the chair body 1, the user's body weight is cushioned by the first cushion mechanisms 4 and the second cushion mechanisms 5. The curved surfaces of the two sled runner-shaped supports 11 at the front bottom portion of the chair body 1 and the pivotable design of the extension bar 3 allow the extension bar 3 to move backward and thereby tilt the chair body 1 to a certain angle according to the user's sitting position.

The principle on which the angle of the chair body 1 is changed is detailed below. When the chair body 1 is subjected to the user's body weight, the two sled runner-shaped supports 11 at the front bottom portion of the chair body 1 move along their curved surfaces, thus tilting the chair body 1 backward. The backward tilt of the chair body 1 applies a pressure to the extension bar 3 via the second cushion mechanisms 5, such that the extension bar 3 is moved to a particular angle to support the chair body 1 and keep the chair body 1 at that particular angle. Therefore, in addition to cushioning the user's body weight, the second cushion mechanisms 5 are a major component for displacing the extension bar 3.

Besides, with the first and second cushion mechanisms 4, 5 cushioning the body weight of the user sitting on the chair body 1, the extension bar 3 is moved backward slowly but not rapidly until the chair body 1, subjected to the user's body weight, is tilted to the particular angle. As the tilt angle of the chair body 1 varies with the center of gravity of the user seated on the chair body 1, the extension bar 3 will be extracted (i.e., moved forward) if the user leans forward, thus reducing the tilt angle of the chair body 1.

In contrast to the conventional chairs which only allow their chair heights and backrest tilt angles to be adjusted, the chair structure of the present invention, once sat on, is capable of automatically adjusting the overall tilt angle of the chair body 1 in response to a change of the sitter's center of gravity, thanks to the cushioning of the first and second cushion mechanisms 4, 5 and the back-and-forth movement of the extension bar 3. Thus, sitting comfort is ensured.

What is claimed is:

1. An automatically adjustable chair structure, essentially comprising:

a chair body having a front bottom portion extended with two corresponding sled runner-shaped supports;

a base provided at a bottom portion of the chair body;

an extension bar having an end pivotally connected to a bottom portion of the base;

at least a first cushion mechanism provided between the chair body and the base; and at least a second cushion mechanism pivotally connected between the bottom portion of the base and the extension bar;

wherein when a user sits on the chair body, the user's body weight is cushioned by the at least a first cushion mechanism and the at least a second cushion mechanism, and the sled runner-shaped supports are configured to allow the extension bar to move backward, thereby changing a tilt angle of the chair body to suit the user's sitting posture.

2. The automatically adjustable chair structure of claim 1, wherein the extension bar has an opposite end provided with a caster.

3. The automatically adjustable chair structure of claim 1, wherein each said first cushion mechanism is provided therein with at least a resilient element.

4. The automatically adjustable chair structure of claim 1, wherein each said second cushion mechanism is a hydraulic or pneumatic cylinder.

* * * * *